US006372707B1

(12) United States Patent
Boskamp et al.

(10) Patent No.: US 6,372,707 B1
(45) **Date of Patent: *Apr. 16, 2002**

(54) CLEANING COMPOSITIONS

(75) Inventors: Jelles Vincent Boskamp; Edwin Leo Lempers, both of Vlaardingen (NL)

(73) Assignee: Lever Brothers Company, division of Conopco, Inc., New York, NY (US)

( * ) Notice: Subject to any disclaimer, the term of this patent is extended or adjusted under 35 U.S.C. 154(b) by 21 days.

This patent is subject to a terminal disclaimer.

(21) Appl. No.: 09/093,633

(22) Filed: Jun. 4, 1998

(30) Foreign Application Priority Data

Jun. 6, 1997 (EP) ..... 97303924

(51) Int. Cl.[7] ..... C11D 1/94; C11D 3/22; C11D 3/12; C11D 17/00

(52) U.S. Cl. ..... 510/440; 510/305; 510/309; 510/312; 510/320; 510/374; 510/446; 510/447; 510/470; 510/471; 510/473

(58) Field of Search ..... 510/305, 309, 510/312, 320, 374, 440, 446, 447, 470, 471, 473

(56) References Cited

U.S. PATENT DOCUMENTS

| | | | | |
|---|---|---|---|---|
| 2,560,097 A | | 7/1951 | Emerson et al. | 252/89 |
| 3,370,015 A | | 2/1968 | Van Kampen et al. | 510/446 |
| 3,417,024 A | | 12/1968 | Goldwasser | 510/446 |
| 4,828,745 A | | 5/1989 | Jeschke et al. | 252/99 |
| 4,828,749 A | | 5/1989 | Kruse et al. | 252/135 |
| 5,133,892 A | | 7/1992 | Chun et al. | 252/90 |
| 5,360,567 A | * | 11/1994 | Fry et al. | 510/298 |
| 5,783,540 A | | 7/1998 | Secemski et al. | 510/224 |
| 5,837,663 A | | 11/1998 | Nicholson et al. | 510/226 |
| 5,900,399 A | | 5/1999 | Seiter et al. | 510/446 |
| 6,051,545 A | * | 4/2000 | Boskamp | 510/446 |

FOREIGN PATENT DOCUMENTS

| | | |
|---|---|---|
| CA | 2226143 | 1/1997 |
| CA | 2298948 | 5/2000 |
| CH | 471891 | 6/1969 |
| EP | 0 002 293 | 6/1978 |
| EP | 151 203 | 8/1985 |
| EP | 0 466 484 | 1/1992 |
| EP | 0 466 485 | 1/1992 |
| EP | 0 522 766 | 1/1993 |
| EP | 0 716 144 | 6/1996 |
| EP | 0 838 519 | 4/1998 |
| EP | 0 839 906 | 5/1998 |
| EP | 851 025 | 7/1998 |
| WO | 95/04804 | 2/1995 |
| WO | 95/21908 | 8/1995 |
| WO | 96/23053 | 8/1996 |
| WO | 97/03177 | 1/1997 |
| WO | 98/03064 | 1/1998 |
| WO | 98/40462 | 9/1998 |
| WO | 98/42816 | 10/1998 |
| WO | 98/42817 | 10/1998 |
| WO | 98/40464 | 12/1998 |
| WO | 98/55582 | 12/1998 |
| WO | 98/55590 | 12/1998 |
| WO | 99/20730 | 4/1999 |
| WO | 99/35230 | 7/1999 |

OTHER PUBLICATIONS

PCT application in a PCT International Search Report, PCT/EP 99/09183, Sep. 1999.

PCT application in a PCT International Search Report, PCT/EP 99/09175, Nov. 1999.

PCT International Search Report in a PCT application PCT/EP 00/05312, Mar. 2000.

Encyclopedia of Chemical Technology, vol. 4, pp. 945–946 and vol. 5, pp. 545–548, Feb. 1999.

* cited by examiner

*Primary Examiner*—Gregory Delcotto
(74) *Attorney, Agent, or Firm*—Rimma Mitelman

(57) ABSTRACT

A tablet of compacted particulate cleaning composition which contains surfactant and detergency builder, and is suitable for fabric washing, also includes water-insoluble, water-swellable polymeric material, and disintegration-promoting particles containing at least 40% (by weight of the particles) of one or more materials selected from:

compounds with a water-solubility exceeding 50 grams per 100 grams water phase 1 sodium tripolyphosphate sodium tripolyphosphate which is partially hydrated so as to contain water of hydration in an amount which is at least 0.5% by weight of the sodium tripolyphosphate in the disintegration-promoting particles.

15 Claims, No Drawings

CLEANING COMPOSITIONS

FIELD OF THE INVENTION

This invention relates to cleaning compositions in the form of tablets for use in fabric washing.

BACKGROUND AND SUMMARY OF PRIOR ART

Detergent compositions in tablet form are described, for example, in GB 911204 (Unilever), U.S. Pat. No. 3,953,350 (Kao), JP 60-015500A (Lion) and EP-A-711827 (Unilever); and are sold commercially in Spain. Tablets have advantages over powdered products in that they do not require measuring and are thus easier to handle and dispense into the washload.

Tablets of a detergent composition are generally made by compressing or compacting a quantity of the composition in particulate form. It is desirable that tablets have adequate strength when dry, yet disperse and dissolve quickly when added to wash water. In such tablets the surfactant functions as a binder, plasticising the tablet. However, it can also retard disintegration of the tablet by forming a viscous gel when the tablet comes into contact with water.

It can be difficult, to obtain both tablet strength and an ability to disperse and dissolve quickly in the wash liquor. Tablets formed using only a light compaction pressure tend to crumble and disintegrate on handling and packing; while more strongly compacted tablets may be sufficiently cohesive but then fail to disintegrate or disperse to an adequate extent in the wash.

This problem has proved especially acute with tablets formed by compressing powders containing surfactant and built with insoluble detergency builder such as sodium aluminosilicate (zeolite).

It is known to include materials whose function is to enhance disintegration of tablets when placed in wash water. Some tablets which are sold commercially incorporate urea for this purpose. Urea has a very high solubility in water exceeding 100 gms per 100 ml water at 20° C.

SUMMARY OF THE INVENTION

We have now found that the disintegration of tablets of cleaning composition can be accelerated by incorporating in the tablet a quantity of a water-insoluble but water-swellable polymeric material.

However, we have observed that particles of water-swellable but water-insoluble material which are effective to cause tablet disintegration are liable to be retained on the washed laundry as visible residues.

We therefore propose, in the present invention, that the disintegration and dissolution of tablets is brought about by a combination of two materials. One is a water-swellable but water-insoluble polymeric material. The other is a water-soluble compound which enhances dissolution.

According to the present invention, there is provided a tablet of compacted particulate cleaning composition, containing overall from 5 to 50 wt % surfactant and from 5 to 80 wt % detergency builder wherein the tablet or a discrete region thereof which contains surfactant and detergency builder also contains (i) water-insoluble, water-swellable polymeric material, and (ii) particles functioning to aid and dissolution/disintegration and containing at least 40% (by weight of these particles (ii)) of one or more materials selected from compounds with a water-solubility exceeding 50 grams per 100 grams water phase I sodium tripolyphosphate or sodium tripolyphosphate which is partially hydrated so as to contain water of hydration in an amount which is at least 0.5% by weight of the sodium tripolyphosphate in the particles.

As will be explained further below, these disintegration-promoting particles can also contain other forms of . tripolyphosphate or other salts within the balance of their composition.

DETAILED DESCRIPTION AND EMBODIMENTS

A tablet of the invention may be either homogeneous or heterogeneous. In the present specification, the term "homogeneous" is used to mean a tablet produced by compaction of a single particulate composition, but does not imply that all the particles of that composition will necessarily be of identical composition. The term "heterogeneous" is used to mean a tablet consisting of a plurality of discrete regions, for example layers, inserts or coatings, each derived by compaction from a particulate composition. In a heterogenous tablet according to the present invention, each discrete region of the tablet will preferably have a mass of at least 5 gm.

In a heterogeneous tablet, at least one of the discrete regions contains the said swellable polymeric material and disintegration-promoting particles together with surfactant and detergency builder in accordance with the invention.

A preferred tablet or a discrete region thereof contains from 2 or 5 wt % up to 40 or 50 wt %, or 8 to 49 wt % surfactant, from 5 or 10 up to 60 or 80 wt % detergency builder and from 0.5 to 10 wt %, or 0.1 to 8 wt % of the water-insoluble but swellable polymeric material. Where a tablet is heterogenous, these percentage ranges for surfactant and builder may apply to the overall composition of the tablet, as well as to at least one discrete region of the tablet.

If the material in the disintegration-promoting particles can function as a detergency builder, (as is the case with sodium tripolyphosphate) then of course it contributes to the total quantity of detergency builder in the tablet composition.

The quantity of disintegration-promoting particles is suitably from 5 or 8 wt % up to 25 or 40 wt % of the tablet or region thereof. Benefits from water-insoluble, swellable polymeric material can be obtained when it is present in amounts from 0.5 better 0.9 up to at least 2.7 or 3.5 wt % of the tablet or region thereof. It may possibly be used in larger amounts such as up to 5 or 8 wt %.

In a heterogenous tablet, the polymeric material may be incorporated in some only of a plurality of discrete regions (eg. in only one of two) while other region(s) contain a lesser concentration, or more, of the polymeric material. Such an arrangement may be used to cause the regions of the tablet to disintegrate and dissolve (in so far as their constituents are soluble) at different rates.

The Water-swellable Polymer

Suitable water-swellable polymeric materials preferably have sufficient water-absorptivity that they can absorb at least four times their own weight of water, ie. a water uptake of at least 4 gm per gm.

A number of such materials are known, and are generally based on cellulose which may be chemically modified to enhance its water uptake capacity. Sometimes such modified celluloses have ionic substituents but for this invention it is preferred that any substituents are nonionic.

Surprisingly, we have found that such a material is more effective if it has a relatively large particle size. We therefore prefer that the polymeric material has a particle dimension of at least 400 preferably at least 500 micrometers. Such polymeric material with a particle dimension of at least 400 micrometers is preferably an agglomerate of smaller particles whose largest dimension is no greater than 150 or 200 micrometers, better no greater than 50 micrometers. This makes it possible for at least some of the polymer particles to break up during a wash cycle, and not remain as visible residues in fabrics. While this is advantageous, we have observed that since particles nevertheless remain intact and can be observed as residues.

The material may exist as relatively rounded particles, or as relatively flat particles such as flakes or discs. In the latter case a dimension (diameter) of the flakes will be larger, perhaps substantially larger, than the diameter of a sphere with the same volume.

The largest dimension of particles of the polymeric material may be determined by sieve analysis, and the shape of the particles can be observed under a microscope.

It is customary to use sodium carboxymethylcellulose (SCMC) in detergent compositions, usually as not more than 3 wt % of the composition. We have found that such quantities of SCMC are generally ineffective to promote tablet disintegration.

We have found it desirable to use swellable polymeric materials with little or no ionic character. Such materials may be polysaccharides with little or no ionic substitution.

The absence or near absence of ionic substitution can be expressed by stating that the charge density of the polymeric material is low, such as less than $10^{-3}$, better less than $6\times10^{-4}$ or even zero. The term "charge density" denotes the number of charges on a polymer molecule divided by the molecular weight of the polymer. It is essentially the same as the average number of charges on a repeat unit of the polymer divided by the average molecular weight of a repeat unit.

The water-insoluble, water-swellable polymeric material is preferably added as particles which contain such material as at least 75% of the anhydrous weight of these particles (ie. ignoring their moisture content). Usually they will contain little or nothing except the polymer and any accompanying moisture.

Disintegration-promoting Particles

One possibility is that these particles contain at least 40% of their own weight, preferably at least 50%, of a material which has a solubility in deionised water at 20° C. of at least 50 grams per 100 grams of water.

The said particles may provide material of such solubility in an amount which is at least 7 wt % or 12 wt % of the whole composition of the tablet or discrete region thereof.

A solubility of at least 50 grams per 100 grams of water at 20° C. is an exceptionally high solubility: many materials which are classified as water soluble are less soluble than this.

Some highly water-soluble materials which may be used are listed below, with their solubilities expressed as grams of solid to form a saturated solution in 100 grams of water at 20° C.:

| Material | Water Solubility (g/100 g) |
|---|---|
| Sodium citrate dihydrate | 72 |
| Potassium carbonate | 112 |
| Urea | >100 |
| Sodium acetate | 119 |
| Sodium acetate trihydrate | 76 |
| Magnesium sulphate $7H_2O$ | 71 |

By contrast the solubilities of some other common materials at 20° C. are:

| Material | Water Solubility (g/100 g) |
|---|---|
| Sodium chloride | 36 |
| Sodium sulphate decahydrate | 21.5 |
| Sodium carbonate anhydrous | 8.0 |
| Sodium percarbonate anhydrous | 12 |
| Sodium perborate anhydrous | 3.7 |
| Sodium tripolyphosphate anhydrous | 15 |

Preferably this highly water soluble material is incorporated as particles of the material in a substantially pure form (i.e. each such particle contains over 95% by weight of the material). However, the said particles may contain material of such solubility in a mixture with other material, provided that material of the specified solubility provides at least 40% by weight of these particles.

It may be preferred that the highly water-soluble material is a salt which dissolves in water in an ionised form. As such a salt dissolves it leads to a transient local increase in ionic strength which can assist disintegration of the tablet by preventing nonionic surfactant from swelling and inhibiting dissolution of other materials.

Another possibility is that the said particles which promote disintegration are particles containing sodium tripolyphosphate with more than 40% (by weight of the particles) of the anhydrous phase I form.

Sodium tripolyphosphate is very well known as a sequestering builder in detergent compositions. It exists in a hydrated form and two crystalline anhydrous forms. These are the normal crystalline anhydrous form, known as phase II which is the low temperature form, and phase I which is stable at high temperature. The conversion of phase II to phase I proceeds fairly rapidly on heating above the transition temperature, which is about 420° C., but the reverse reaction is slow. Consequently phase I sodium tripolyphosphate is metastable at ambient temperature.

A process for the manufacture of particles containing a high proportion of the phase I form of sodium tripolyphosphate by spray drying below 420° C. is given in U.S. Pat. No. 4,536,377.

Particles which contain this phase I form will often contain the phase I form of sodium tripolyphosphate as at least 50% or 55% by weight of the tripolyphosphate in the particles.

Suitable material is commercially available. Suppliers include Rhone-Poulenc, France and Albright & Wilson, UK.

Another possibility is that the particles which promote. disintegration are particles which contain at least 40 wt % sodium tripolyphosphate which is partially hydrated. The extent of hydration should be at least 0.5% by weight of the sodium tripolyphosphate in the particles. It may lie in a range from 0.5 to 4%, or it may be higher. Indeed fully hydrated sodium tripolyphosphate may be used to provide these particles.

It is possible that the particles contain at least 40 wt % sodium tripolyphosphate which has a high phase I content but is also sufficiently hydrated so as to contain at least 0.5% water by weight of the sodium tripolyphosphate.

The remainder of the tablet composition used to form the tablet or region thereof may include additional sodium tripolyphosphate. This may be in any form, including sodium tripolyphosphate with a high content of the anhydrous phase II form.

When the said particles contain sodium tripolyphosphate, it is preferable that they provide sodium tripolyphosphate, in a quantity which is at least 8%, e.g. 8 to 30%, by weight of the composition of the tablet or region thereof.

A zero phosphate tablet in accordance with this invention will utilise disintegration-promoting particles containing material with solubility of at least 50 gm/100 gm.

Such material may also be used in phosphate built tablets, but it is more likely that these will utilise particles containing phase I and/or hydrated sodium tripolyphosphate.

When the particles contain sodium tripolyphosphate, it will function as a builder after the tablet or tablet region disintegrates and dissolves the wash liquor.

The total quantity of sodium tripolyphosphate, in all forms, present in a tablet composition may lie in a range from 15 to 60% by weight of the tablet. Therefore it will be appreciated that the overall quantity of sodium tripolyphosphate may be provided at least partially by other material in addition to the said particles.

The said particles to promote disintegration will generally be mixed with other particles containing the surfactant, at least some builder and other constituents of the composition, to provide the overall composition which is compacted into a tablet or a region of a tablet.

Surfactant Compounds

Compositions which are compacted to form tablets or tablet regions of this invention generally contain one or more organic detergent surfactants. In a fabric washing composition, these preferably provide from 5 to 50% by weight of the overall tablet composition, more preferably from 8 or 9% by weight of the overall composition up to 40% or 50% by weight. Surfactant may be anionic (soap or non-soap), cationic, zwitterionic, amphoteric, nonionic or a combination of these.

Anionic surfactant may be present in an amount from 0.5 to 50% by weight, preferably from 2% or 4% up to 30% or 40% by weight of the tablet composition.

Synthetic (i.e. non-soap) anionic surfactants are well known to those skilled in the art. Examples include alkylbenzene sulphonates, particularly sodium linear alkylbenzene sulphonates having an alkyl chain length of $C_8$–$C_{15}$; olefin sulphonates; alkane sulphonates; dialkyl sulphosuccinates; and fatty acid ester sulphonates.

Primary alkyl sulphate having the formula $$ROSO_3^-M^+$$

in which R is an alkyl or alkenyl chain of 8 to 18 carbon atoms especially 10 to 14 carbon atoms and $M^+$ is a solubilising cation, is commercially significant as an anionic surfactant.

Linear alkyl benzene sulphonate of the formula

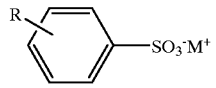

where R is linear alkyl of 8 to 15 carbon atoms and $M^+$ is a solubilising cation, especially sodium, is also a commercially significant anionic surfactant.

Frequently, such linear alkyl benzene sulphonate or primary alkyl sulphate of the formula above, or a mixture thereof will be the desired anionic surfactant and may provide 75 to 100 wt % of any anionic non-soap surfactant in the composition.

In some forms of this invention the amount o f non-soap anionic surfactant lies in a range from 5 to 20 wt % of the tablet composition.

It may also be desirable to include one or more soaps of fatty acids. These are preferably sodium soaps derived from naturally occurring fatty acids, for example, the fatty acids from coconut oil, beef tallow, sunflower or hardened rapeseed oil.

Suitable nonionic surfactant compounds which may be used include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 5 to 20 moles of ethylene oxide per mole of alcohol.

In certain forms of this invention the amount of nonionic surfactant lies in a range from 4 to 40%, better 4 or 5 to 30% by weight of the composition. Many nonionic surfactants are liquids. These may be absorbed onto particles of the composition, prior to compaction into tablets.

Detergency Builder

A composition which is compacted to form tablets or tablet regions will generally contain from 5 better 15 wt % up to 80%, more usually 15 to 60% by weight of detergency builder. This may be provided wholly by water soluble materials, or may be provided in large part or even entirely by water-insoluble material with water-softening properties. Water-insoluble detergency builder may be present as 5 to 80 wt %, better 5 to 60 wt % of the composition.

Alkali metal aluminosilicates are strongly favoured as environmentally acceptable water-insoluble builders for fabric washing. Alkali metal (preferably sodium) aluminosilicates may be either crystalline or amorphous or mixtures thereof, having the general formula:

$$0.8\text{–}1.5Na_2O.Al_2O_3.0.8\text{–}6SiO_2.\ xH_2O$$

These materials contain some bound water (indicated as $xH_2O$) and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1429143 (Procter & Gamble). The preferred sodium aluminosilicates of this type are the well known commercially available zeolites A and X, the newer zeolite P described and claimed in EP 384070 (Unilever) and mixtures thereof.

Conceivably a water-insoluble detergency builder could be a layered sodium silicate as described in U.S. Pat. No. 4664839. NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used.

Water-soluble phosphorus-containing inorganic detergency builders, include the alkali-metal orthophosphates, metaphosphates, pyrophosphates and polyphosphates. Specific examples of inorganic phosphate builders include sodium and potassium tripolyphosphates, orthophosphates and hexametaphosphates. As mentioned above, sodium tripolyphosphate (if any) included in the said particles to promote disintegration will also be part of the detergency builder.

Non-phosphorus water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Tablet compositions preferably include polycarboxylate polymers, more especially polyacrylates and acrylic/maleic copolymers which can function as builders and also inhibit unwanted deposition onto fabric from the wash liquor.

Bleach System

Tableted detergent compositions according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

Other Detergent Ingredients

The detergent tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N.V., Delft, Holland, and Alcalase (Trade Mark), and Savinase (Trade Mark), as supplied by Novo Industri A/S, Copenhagen, Denmark. Detergency enzymes are commonly employed in the form of granules or marumes, optionally with a protective coating, in amount of from about 0.1% to about 3.0% by weight of the composition; and these granules or marumes present no problems with respect to compaction to form a tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included, especially if a detergent tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material. Antifoam granules may be present in an amount up to 5% by weight of the composition.

It may also be desirable that a detergent tablet of the invention includes an amount of an alkali metal silicate, particularly sodium ortho-, meta- or disilicate. The presence of such alkali metal silicates at levels, for example, of 0.1 to 10 wt %, may be advantageous in providing protection against the corrosion of metal parts in washing machines, besides providing some measure of building and giving processing benefits in manufacture of the particulate material which is compacted into tablets. A composition for fabric washing will generally not contain more than 15 wt % silicate. A tablet for machine dishwashing will frequently contain at least 20 wt % silicate.

Further ingredients which can optionally be employed in fabric washing detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; and colorants or coloured speckles.

Particle Size and Distribution

A detergent tablet of this invention, or a discrete region of such a tablet, is a matrix of compacted particles.

Preferably the particulate composition has an average particle size in the range from 200 to 2000 $\mu$m, more preferably from 250 to 1400 $\mu$m. Fine particles, smaller than 180 μm or 200 μm may be eliminated by sieving before tableting, if desired, although we have observed that this is not always essential.

While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/liter, preferably at least 500 g/liter, and possibly at least 600 g/liter.

A composition which is compacted into a tablet or tablet region may contain particles which have been prepared by spray-drying or granulation and which contain a mixture of ingredients. Such particles may contain the surfactant and some or all of the detergency builder.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

Preferably, separate particles of water-insoluble, water-swellable polymeric material, and the said particles which promote disintegration, are both mixed with the remainder of the particulate composition prior to compaction.

Tableting

Tableting entails compaction of a particulate composition. A variety of tableting machinery is known, and can be used. Generally it will function by stamping a quantity of the particulate composition which is confined in a die.

Tableting may be carried out at ambient temperature or at a temperature above ambient which may allow adequate strength to be achieved with less applied pressure during compaction. In order to carry out the tableting at a temperature which is above ambient, the particulate composition is preferably supplied to the tableting machinery at an elevated temperature. This will of course supply heat to the tableting machinery, but the machinery may be heated in some other way also.

If any heat is supplied, it is envisaged that this will be supplied conventionally, such as by passing the particulate composition through an oven, rather than by any application of microwave energy.

The size of a tablet will suitably range from 10 to 160 grams, preferably from 15 to 60 g, depending on the conditions of intended use, and whether it represents a dose for an average load in a fabric washing or dishwashing machine or a fractional part of such a dose. The tablets may be of any shape. However, for ease of packaging they are preferably blocks of substantially uniform cross-section, such as cylinders or cuboids. The overall density of a tablet preferably lies in a range from 1040 or 1050 gm/liter up to 1300 gm/liter. The tablet density may well lie in a range up to no more than 1250 or even 1200 gm/liter.

EXAMPLES

Example 1

Tablets for use in fabric washing were made, starting with a spray-dried base powder of the following composition:

| Ingredient | Parts by weight |
|---|---|
| Sodium linear alkylbenzene sulphonate | 11.0 |
| Sodium tripolyphosphate* | 16.8 |
| $C_{13-15}$ fatty alcohol 7EO | 2.4 |
| $C_{13-15}$ fatty alcohol 3EO | 2.3 |
| Sodium silicate | 4.0 |
| Soap | 0.21 |
| Acrylate/maleate copolymer | 1.5 |
| Sodium sulphate, moisture and minor ingredients | balance to 45 parts |

*Added to the slurry as anhydrous sodium tripolyphosphate containing at least 70% phase II form.

A number of particulate compositions were made by mixing this powder with other ingredients as tabulated below. These included particles of sodium tripolyphosphate specified to contain 70% phase I form and contain 3.5% water of hydration (Rhodia-Phos HPA 3.5 available from Rhone-Poulenc).

The added ingredients also included particles of water-insoluble water-swellable polymeric material. This material was derived from cellulose and supplied by Rettenmaier GmbH as "Arbocel A1". It was in the form of particles with a range of shapes and particle sizes (as determined by sieve analysis) with an average diameter of 1 mm. It was found to have a water-uptake of 5.7 gm/gm.

For some compositions this material was sieved to provide a fraction with a narrower range of particle size.

The compositions were balanced to 100% by including varying amounts of dense anhydrous sodium carbonate.

The various compositions contained the following percentages by weight:

| Ingredient | % by weight |
|---|---|
| Base powder | 45.0 |
| Sodium percarbonate granules | 15.0 |
| TAED granules | 3.4 |
| Anti-foam granules | 3.2 |
| Perfume, enzymes and other minor ingredients | 3.5 |
| HPA tripolyphosphate | variable, 15 to 30% |
| Water-swellable polymer | variable, 0 to 5% |
| Sodium carbonate | balance, 0 to 15% |

40 g portions of each composition were made into cylindrical tablets of 44 mm diameter, using a Fette pilot plant press, so as to produce tablets with density in a range from 1100 to 1250 kg/m$^3$.

The strength of these tablets was measured using an Instron universal testing machine to compress a tablet until fracture. The value of diametral fracture stress (DFS) was then calculated using the equation $$\sigma = \frac{2P}{\pi D t}$$

where σ is the diametral fracture stress in Pascals, P is the applied load in Newtons to cause fracture, D is the tablet diameter in meters and t is the tablet thickness in meters.

The break-up, dispersion and dissolution of tablets was measured by a test procedure in which a tablet is placed on a plastic sieve with 2 mm mesh size which was immersed in 9 liters of demineralised water at ambient temperature of 22°

C. and rotated at 200 rpm. The water conductivity was monitored until it reached a constant value.

The time for break up and dispersion of the tablets was taken as the time ($T_{90}$) for change in the water conductivity to reach 90% of its final magnitude. This was also confirmed by visual observation of the material remaining on the rotating sieve. Additionally, the initial gradient of a graph of conductivity against time was noted and expressed as a normalised value relative to that of one of the compositions.

The percentages of HPA tripolyphosphate, and polymeric material, together with the DFS and conductivity results are set out in the following table:

| # | HPA tripoly-phosphate | polymeric material | balancing carbon-ate | DFS (kpa) | $T_{90}$ (minute) | Gradient of conduc-tivity/time curve |
|---|---|---|---|---|---|---|
| 1A | 30% | 0 | 0 | 43 | 3.0 | 1 |
| 1B | 27.5% | 0 | 2.5% | 30 | 2.5 | 2 |
| 1C | 15% | 0 | 15% | 32 | 8.7 | 1 |
| 1D | 24% | 2% as supplied | 4% | 32 | 3.2 | 3.3 |
| 1E | 15% | 5% as supplied | 10% | 18 | 1.6 | 26 |
| 1F | 20% | 1.5% as supplied | 8.5% | 50 | 6.0 | 2.3 |
| 1G | 15% | 5% 470–800 μ | 10% | 30 | 3.2 | 16 |
| 1H | 15% | 5% 800–1400 μ | 10% | 21 | 1.4 | 23 |
| 1J | 15% | 3% 800–1400 μ | 12% | 33 | 2.8 | 16 |

Example 2

Tablets with a weight of 40 g were prepared as in Example 1, using the same spray dried base powder, but different added ingredients, as set out in the following table:

| Ingredient | % by weight |
|---|---|
| Base powder | 58.0 |
| Polyvinylpyrrolidone | 0.6 |
| Anti-foam granules | 4.2 |
| Perfume, enzymes and other minor ingredients | 2.0 |
| Sodium citrate dihydrate | 20.0 |
| Water-swellable polymer 800–1400 μ | 3.0 |
| Sodium carbonate | balance to 100% |

Example 3

Tablets for use in fabric washing were made, starting with a base powder of the following composition:

| Ingredient | parts by weight |
|---|---|
| Sodium linear alkylbenzene sulphonate | 10.7 |
| $C_{13-15}$ fatty alcohol 7EO. | 1.7 |
| $C_{13-15}$ fatty alcohol 3EO. | 3.1 |
| Zeolite A24 | 21.0 |
| Sodium carbonate | 3.7 |
| Sodium citrate dihydrate | 3.1 |
| moisture and minors | 5.6 |
| TOTAL | 48.9 |

Three particulate compositions were made by mixing this powder with other ingredients as set out in the table below. The water-swellable polymer was "Arbocel A1" used as supplied. Portions of each composition, with a weight of 40 g, were compacted into tablets using compaction pressures such that the tablets had equal values of Diametral Fracture Strength, measured as in Example 1 above. They were tested for disintegration and dissolution as in Example 1 and the $T_{90}$ conductivity values are shown at the foot of the table.

| Ingredient | % by weight | | |
|---|---|---|---|
| Base powder | 48.9 | 48.9 | 48.9 |
| Sodium perborate monohydrate | 13.9 | 13.9 | 13.9 |
| TAED granules | 5.3 | 5.3 | 5.3 |
| Anti-foam granules | 2.0 | 2.0 | 2.0 |
| Fluorescer granules | 1.2 | 1.2 | 1.2 |
| Sodium silicate granules | 3.7 | 3.7 | 3.7 |
| Acrylate/maleate copolymer | 1.0 | 1.0 | 1.0 |
| Perfume, enzymes and other minor ingredients | 3.5 | 3.5 | 3.5 |
| Sodium acetate trihydrate | 18 | 14.5 | 11.0 |
| Water-swellable polymer | 0 | 1.0 | 2.0 |
| Sodium carbonate | 2.5 | 5.0 | 7.5 |
| TOTAL | 100 | 100 | 100 |
| $T_{90}$ (minutes) | >10 | 8.3 | 5.7 |

Example 4

The procedure of the previous example was repeated, using a base powder containing primary alkyl sulphate in place of alkyl benzene sulphate as the anionic surfactant. One composition contained 3 wt % of "Arbocel A1". It was observed to have a $T_{90}$ time of 2 minutes. A comparative composition without "Arbocel A1", made with the same DFS value of 33 kPa, had a $T_{90}$ time of 7.5 minutes.

Example 5

Tablets with a weight of 40 g for use in fabric washing were made, starting with a granulated base powder of the following composition:

| Ingredient | parts by weight |
|---|---|
| Sodium linear alkylbenzene sulphonate | 7.7 |
| $C_{13-15}$ fatty alcohol 7EO. | 3.5 |
| $C_{13-15}$ fatty alcohol 3EO. | 3.7 |
| Zeolite A24 | 25.2 |
| Sodium citrate dihydrate | 2.6 |
| Sodium sulphate, moisture and minors | balance to 50 parts |

This powder was then mixed with further ingredients to form particulate compositions which were then compacted into tablets as in previous examples. These compositions were as follows:

| Ingredient | % by weight | |
|---|---|---|
| Base powder | 50.0 | 67.0 |
| Sodium perborate monohydrate | 14.3 | — |
| TAED granules | 5.5 | — |
| Anti-foam granules | 1.0 | 2.0 |
| Fluorescer granules | 1.0 | — |
| Sodium silicate granules | 3.7 | — |

-continued

| Ingredient | % by weight | |
|---|---|---|
| Acrylate/maleate copolymer | 1.0 | 1.8 |
| Sodium carbonate | — | 3.2 |
| Water-swellable polymer | 3.0 | 3.0 |
| Sodium citrate dihydrate | 18 | 20 |
| Perfume, enzymes and other minor ingredients | 2.5 | 3.0 |

What is claimed is:

1. A tablet of compacted particulate composition, containing overall from 5 to 50% by weight of surfactant and from 5 to 80% by weight of detergency builder wherein the tablet or a discrete region thereof which contains surfactant and detergency builder also includes particles containing water-insoluble, water-swellable polysaccharide as at least 75% of the anhydrous weight of these particles, and having a particle dimension of at least 400 micrometers, wherein the tablet or a discrete region thereof contains from 0.5% to 10% by weight of the polysaccharide, and from 5 to 40% of disintegration-promoting particles which are mixed in with the surfactant and the builder and which contain at least 40% (by weight of the particles) of a water-soluble material which enhances dissolution and which is selected from the group consisting of a compound selected from the group consisting of sodium citrate dihydrate, potassium carbonate, urea, sodium acetate, sodium acetate trihydrate, magnesium sulphate $7H_2O$, and phase I sodium tripolyphosphate.

2. A tablet according to claim 1 wherein said disintegration-promoting particles in the tablet or region thereof contain at least 40% by weight of the particles of phase I sodium tripolyphosfate which is partially hydrated so as to contain water of hydration in a range from 0.5 to 4% by weight of these particles.

3. A tablet according to claim 1, wherein the polysaccharide has a particle dimension of at least 500 micrometers.

4. A tablet according to claim 1, wherein the polysaccharide is substantially nonionic such that the charge density of the polysaccharide does not exceed $10^{-3}$.

5. A tablet according to claim 1, wherein the tablet or said discrete region thereof contains from 0.5 to 3.5 wt % of the polysaccharide.

6. A tablet according to claim 5, wherein the tablet or said discrete region thereof contains from 8 to 25 wt % of the disintegration-promoting particles.

7. A tablet according to claim 1, wherein the said detergency builder in the tablet or region thereof comprises water-insoluble detergency builder in an amount from 5 to 60% by weight of the tablet or said region thereof.

8. A tablet according to claim 1, which tablet contains a plurality of discrete regions at least one of which contains a quantity of the said polysaccharide while at least one other region of the tablet contains a lesser concentration of the polysaccharide or none at all.

9. A tablet according to claim 1, which has at least two layers, the composition in at least one layer containing surfactant, detergency builder and the polysaccharide, while at least one other layer contains a lesser concentration of the polysaccharide or none at all.

10. A tablet according to claim 1, which overall contains 5 to 60 wt % water-insoluble detergency builder.

11. A tablet according to claim 1, which overall contains from 10 to 80% by weight of water-soluble detergency builder.

12. A tablet according to claim 1, which overall contains 8 to 49% by weight of surfactant.

13. A tablet according to claim 1 wherein the tablet or said discrete region thereof contains from 0.5 to 5 wt % of the polysaccharide.

14. A tablet according to claim 1 wherein the tablet or the discrete region thereof contains from 0.1 to 8 wt % of said particles containing water-insoluble, water-swellable polysaccharide.

15. A tablet according to claim 1 wherein the tablet or the discrete region thereof contains at most 15% of said disintegration-promoting particles.

* * * * *